United States Patent [19]

DeVrou

[11] 4,004,476

[45] Jan. 25, 1977

[54] SOCKET WRENCH EXTENSION GRIP

[76] Inventor: Kenneth L. DeVrou, 1898 Newcastle Drive, Jenison, Mich. 49428

[22] Filed: July 21, 1975

[21] Appl. No.: 597,833

[52] U.S. Cl. ..... 81/177 A

[51] Int. Cl.[2] ..... B25B 23/00

[58] Field of Search ..... 81/177 R, 177 A, 121 R; 145/61 A

[56] References Cited

UNITED STATES PATENTS

| | | | |
|---|---|---|---|
| 1,632,227 | 6/1927 | Halsey | 81/177 R X |
| 2,851,915 | 9/1958 | Martinez | 81/177 A |
| 3,039,339 | 6/1962 | Hanson | 81/177 A |
| 3,779,105 | 12/1973 | Triplett et al. | 81/121 R |
| 3,868,874 | 3/1975 | Olashaw | 81/121 R |

*Primary Examiner*—Al Lawrence Smith
*Assistant Examiner*—James G. Smith
*Attorney, Agent, or Firm*—Richard A. Kay

[57] ABSTRACT

This invention relates to a hand grip of flexible material for use with a socket wrench extension and which is adapted to be slidably and tightly received upon the socket wrench extension so that the hand grip can be grasped and the socket wrench extension manually turned.

2 Claims, 5 Drawing Figures

SOCKET WRENCH EXTENSION GRIP

The present invention relates to socket wrench extensions and, more particularly, to a hand grip for such socket wrench extensions.

Socket wrench assemblies, which are used to tighten and loosen nuts, bolts, etc., conventionally comprise a handle, a set of extensions of varying lengths, and a set of sockets of varying sizes. The handle includes, at one end thereof, a racheted drive member. The sockets have one end portion adapted to be received either on the drive member of the handle or upon the socket mounting end portion of the extension. And, the other end portion of the socket members have openings of varying sizes which receive nuts, heads of bolts, etc. of corresponding different sizes. Each extention has one end portion which is adapted to be received upon the racheted drive member of the handle and a second end portion which is adapted to mount the different sized socket members. The extensions provide a principal advantage by allowing work to be performed within narrow and enclosed areas where an ordinary wrench could not be placed on the work or turned. Conventionally, the extensions are provided in sets of four with lengths of 1 inch, 2½ inches, 6 inches, and 12 inches. Nevertheless, circumstances do arise where, despite having extensions of sufficient length to engage the work, it is still not possible to manipulate or rotate the handle member because of the enclosed surroundings of the work. Additionally, the extensions are metallic and slippery to grip manually. And, such socket wrench extensions are not normally adapted in any manner for direct manual grasping and turning, such as with a knurled shank. etc. Further, this condition can be compounded where grease and oil contact the extensions. Under such circumstances, it is difficult and sometimes impossible to grasp the extension manually and turn it on the work without the use of the handle. Thus where the handle of the assembly cannot be used, it is desirable to provide extensions with a grip by which the extension can be firmly gripped manually and turned to tighten or loosen the work.

Accordingly, one feature of the present invention is to provide a hand grip for socket wrench extensions by which the extensions can be manually grasped and turned when the work and its environment is such that the handle cannot be used.

Another feature of the present invention is to provide a hand grip for socket wrench extensions, in accordance with the above-stated feature, which is adaptable to fit extensions of varying lengths.

These and other features of the present invention are provided in a preferred embodiment by providing a hand grip for use with a socket wrench extension which is of flexible material and which is adaptable to be slidably and tightly received upon the extension so that the extension can be grasped by the hand grip and turned manually.

These and other features of the present invention will become more fully apparent with reference to the following detailed description and drawing wherein.

Figure 1:
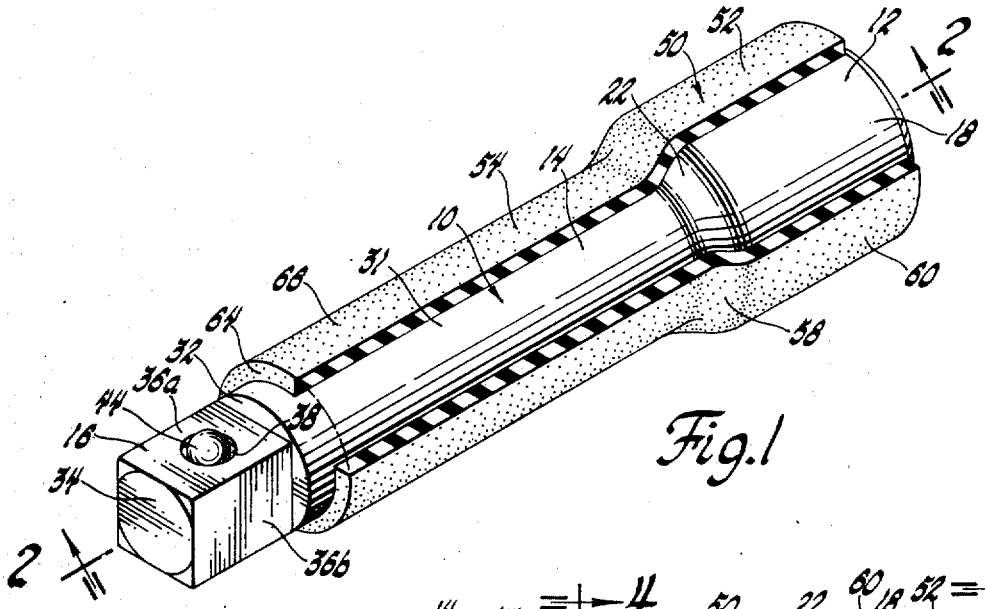
FIG. 1 is a perspective view of the extension and hand grip assembled with portions shown in cross-section.

As representing a preferred embodiment of the present invention, the drawing shows a socket wrench extension 10 which has a drive receiving first end portion 12, a shank portion 14, and a socket mounting second end portion 16. The extension 10 shown in the drawing is representative of the conventional shorter length extension having a length of approximately 2½ inches, but which for purposes of this invention could be of slightly shorter length or of any greater length, such as 6 inches, 12 inches, etc. The drive receiving first end portion 12 of the extension 10 is generally cylindrical in outer shape and diametrically larger than the shank portion 14 and socket mounting second end portion 16. In this respect, the drive receiving first end portion 12 has a smooth cylindrical outer surface 18 which extends axially and terminates at one end at end wall 20 and at the other end in a tapering neck 22. The drive receiving first end portion 12 further consists of a drive receiving opening 24 which extends axially through the end wall 20 and which is defined by axially extending inside walls **26*a–d* and terminates at an inside end wall 28. The opening 24 is generally square in cross-section and complimentary with the racheted drive member of the socket wrench handle. Further, each side wall 26*a–d* includes a generally centrally located, rounded out, recessed opening 30** which receives a recessed, spring-biased locking ball in one side of the drive member of the socket wrench handle. It is notable that the drive receiving first end portion shown in the drawing is merely exemplary of those of conventional extensions and that various modifications can be made regarding size, shape, length, etc.

The shank portion 14 of the extension 10 is also cylindrical in shape with outer surface 31 and extends from the tapered neck 22 of the drive receiving first end portion 12 to the socket mounting second end portion 16, where it terminates at an end wall 32.

The socket mounting second end portion 16 of the extension 10 extends axially along the extension from the end wall 32 of the shank portion 14 and terminates in an end wall 34. Also, the socket mounting second end portion 16 is square in cross-section and has rectangular side walls **36*a–d*, the latter of which is not shown in the drawings. Side wall 36*a* includes a cylindrical opening 38 in its central portion which is defined by a side wall 40 and a bottom wall 42. Received in the cylindrical opening 38 is a locking ball 44 which is biased outwardly by coil spring 46 against an embedded retainer plate 48 which extends across opening 38. The sockets of the socket wrench assembly can then be slidably received upon the socket mounting second end portion 16 of the extension 10 and locked thereon by the locking ball 44 in a conventional manner. It is notable that the socket mounting second end portion 16 of the extension 10 as shown is merely exemplary of those of conventional extensions and may also vary in size, shape and form. As is conventional, no portion of a socket wrench extension 10 is specially adapted for direct manual grasping and turning; i.e., the shank 14** is not knurled, etc.

Figure 2:
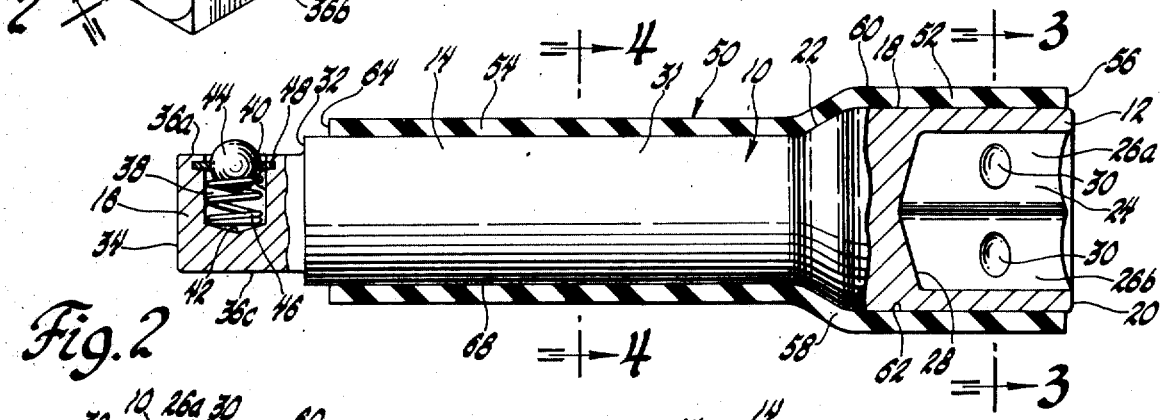
FIG. 2 is a cross-sectional view taken along line 2—2 of FIG. 1.
Figure 5:
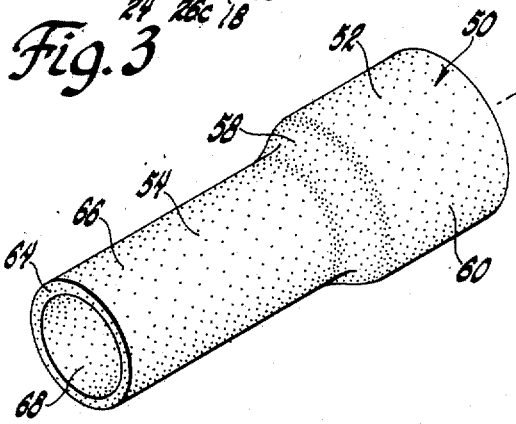
FIG. 5 is a perspective view of the hand grip and socket wrench extension in a disassembled state.
Figure 5:
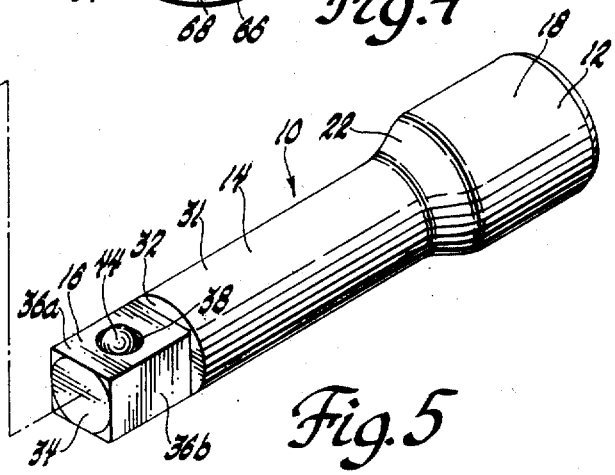

Referring to FIGS. 1, 2 and 5, the hand grip 50 of the present invention is shown. The hand grip 50 is of a flexible material, such as rubber, and basically comprises an upper portion 52 and a lower portion 54. It is generally complimentary with the shape of the drive receiving first end portion 12 and shank portion 14 of the extension 10.

The upper portion 52 of the hand grip 50 is hollow and cylindrical and extends from an end face 56 to a tapered neck 58. Also, the upper portion 52 is defined by an outer surface 60 and an inner surface 62. Finally, the inside diameter of the upper portion 52 is somewhat less than the overall diameter of the drive receiving first end portion 12 of the extension 10.

The lower portion 54 of the hand grip 50 is also shallow and cylindrical and extends from the tapered neck 58 of the upper portion 52 to an end wall 64. Also, the lower portion 54 is defined by an outer surface 66 and an inner surface 68 and has an inside diameter slightly less than the overall diameter of the shank portion 14 of the extension 10.

Finally, the overall length of the hand grip 50 is slightly less than the cummulative lengths of the drive receiving first end portion 12 and shank portion 14 of the extension 10. Thus, the length of the hand grip 50 is less than 2½ inches.

Figure 3:
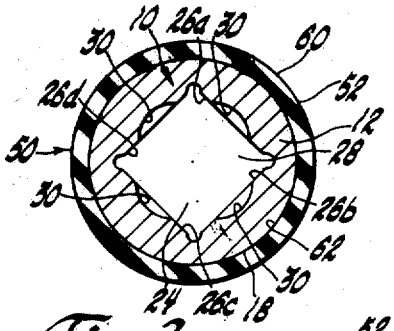
FIG. 3 is a cross-sectional view taken along line 3—3 of FIG. 2.
Figure 4:
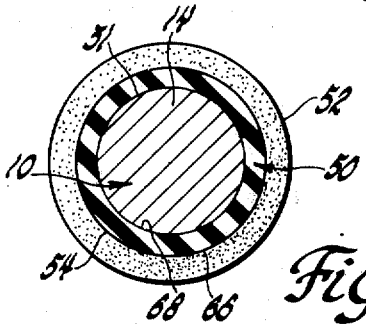
FIG. 4 is a cross-sectional view taken along line 4—4 of FIG. 2.

Referring to FIGS. 3, 4 and 5, the hand grip 50 is slidably received on the extension 10 from the socket mounting first end portion 16. Because the inside diameters of the upper portion 52 and the lower portion 54 of the hand grip 50 are slightly smaller than the overall diameters of the drive receiving first end portion 12 and shank portion 14 of the extension, the hand grip 50 must be pushed on with some force. As the hand grip 50 is axially received upon the drive receiving extension 10, the drive receiving first end portion 12 of the extension 10 is received within the upper portion 52 of the hand grip and the shank portion 14 of the extension 10 is received within the lower portion 54 of the hand grip 50. Again, because of the undersized inside diameters of the upper portion 52 and lower portion 54 of the hand grip 50, the inside surfaces 62 and 68 are tightly received against the outer surfaces 18 and 31, respectively, of the drive receiving first end portion 12 and shank portion 14 of extension 10. As best shown in FIGS. 1 and 2, the upper portion 52 of the hand grip 50 stops short of the end wall 20 of the drive receiving first end portion 12. In this respect, the end wall 56 of the upper portion 52 lies perpendicular to the outer surface 18 of the drive receiving first end portion 12 of the extension 12 and just short of the end wall 20 thereof. Similarly, the lower portion 54 of the hand grip 50 slides past the end wall 48 of the shank portion 14. In this respect, the end wall 64 of the lower portion 54 of the hand grip 50 lies perpendicular to the outer surface 31 of the shank portion 14 and just short of the end wall 32 thereof.

With reference to the aforestated detailed description, it should be recognized that the hand grip 50, being slightly shorter than 2½ inches in length, affords an excellent surface for manual grasping. Also, it should be recognized that the hand grip 50, by reason of its relatively short length, will universally fit extensions of all greater lengths. And, it should be further recognized that the hand grip 50 might also be used effectively in conjunction with an extension 10 which is specially adapted for direct manual grasping and turning; such as an extension with a knurled shank, etc.

The foregoing disclosure relates to only one embodiment of the present invention which may be modified within the scope of the appended claims.

I claim:

1. In combination, a socket wrench extension having a drive receiving first end portion, a shank portion, and a socket mounting second end portion and a hand grip for assisting direct manual grasping and turning of the socket wrench extension, said hand grip being tightly positioned upon said drive receiving first end portion and said shank portion of said socket wrench extension whereby said socket wrench extension can be directly manually grasped by said hand grip and manually turned.

2. In combination, socket wrench extension having an enlarged drive receiving first end portion, a narrow shank portion, and a socket mounting second end portion and a hand grip to assist direct manual grasping and turning of the socket wrench extension, said hand grip having an enlarged hollow upper portion tightly positioned upon said enlarged drive receiving first end portion of said socket wrench extension, said hand grip having a narrow hollow lower portion tightly positioned upon said narrow shank portion of said socket wrench extension whereby said socket wrench extension can be directly manually grasped by said hand grip and manually turned.

* * * * *